US009096083B2

(12) United States Patent
Tsukuda

(10) Patent No.: US 9,096,083 B2
(45) Date of Patent: Aug. 4, 2015

(54) PRINTING APPARATUS, TAPE PRINTING APPARATUS, AND CONTROL METHOD FOR PRINTING APPARATUS

(71) Applicant: Seiko Epson Corporation, Tokyo (JP)

(72) Inventor: Hideyuki Tsukuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/146,664

(22) Filed: Jan. 2, 2014

(65) Prior Publication Data

US 2014/0199105 A1 Jul. 17, 2014

(30) Foreign Application Priority Data

Jan. 11, 2013 (JP) ..... 2013-003258

(51) Int. Cl.
*G06F 15/00* (2006.01)
*B41J 11/00* (2006.01)
*B41J 3/407* (2006.01)

(52) U.S. Cl.
CPC ..... *B41J 11/008* (2013.01); *B41J 3/4075* (2013.01)

(58) Field of Classification Search
CPC ..... B41J 29/38; H04N 2201/0094
USPC ..... 358/1.18
See application file for complete search history.

(56) References Cited

U.S. PATENT DOCUMENTS 6,012,860 A * 1/2000 Nunokawa et al. ..... 400/3

FOREIGN PATENT DOCUMENTS

JP 2001-001603 A 1/2001
JP 3721864 B 11/2005

OTHER PUBLICATIONS

King Jim CO., Ltd., Tepra SR52 User's Manual, Aug. 2006 Third Edition, p. 74 to p. 76.

* cited by examiner

*Primary Examiner* — Saeid Ebrahimi Dehkord
(74) *Attorney, Agent, or Firm* — ALG Intellectual Property, LLC

(57) ABSTRACT

The continuous printing unit prints the input data with a margin length of the input data to be printed adjacent to each other among the plurality of input data set to a predetermined length without using the margin information respectively included in the input data to be printed adjacent to each other.

15 Claims, 8 Drawing Sheets

PRINTING APPARATUS, TAPE PRINTING APPARATUS, AND CONTROL METHOD FOR PRINTING APPARATUS

CROSS-REFERENCE TO RELATED APPLICATION

The entire disclosure of Japanese Patent Application No. 2013-003258, filed Jan. 11, 2013 is expressly incorporated by reference herein.

BACKGROUND

1. Technical Field

The present invention relates to a printing apparatus, a tape printing apparatus, and a control method for the printing apparatus.

2. Related Art

There has been known a tape printing apparatus capable of storing, in an apparatus main body, data of a label created by a user and calling the stored data according to necessity. In the tape printing apparatus of this type, after inputting printing target data (text, image, etc.), a user can store the data as a file by performing predetermined key operation and call the stored file at desired timing (see, for example, King Jim Co., Ltd., "TEPRA" SR220/SR52 User's Manual, August 2006 Third Edition, p. 74 to p. 76).

The user sometimes desires to sequentially call a stored plurality of files and create one label using the tape printing apparatus. That is, the user sometimes desires to create one label obtained by connecting contents stored while being divided into a plurality of files. However, the files include margin information (information concerning the lengths of margins added in the front of and the back of a printing medium (a tape) when the files are printed) set by the user besides characters, images, and the like input by the user. When the files are printed, the margin information is also taken into account. Therefore, when the user sequentially reads out the files and prints the files, the appearance of a label (a print) is deteriorated, for example, margin lengths are unequal among the files.

SUMMARY

An advantage of some aspects of the invention is to provide a printing apparatus, a tape printing apparatus, and a control method for the printing apparatus capable of creating an attractive print even when a stored plurality of data are continuously printed.

An aspect of the invention is directed to a printing apparatus including: a data storing unit configured to store input data including printing information input as information to be printed on a printing medium and margin information indicating the lengths of a front margin and a back margin set in the front and the back in a printing medium feeding direction with respect to a printing region where the printing information is printed on the printing medium; a data selecting unit configured to select a plurality of the input data out of the input data stored in the data storing unit; and a continuous printing unit configured to continuously print the plurality of input data selected by the data selecting unit on the printing medium in the order of the selection. The continuous printing unit prints the input data with a margin length of the input data to be printed adjacent to each other among the plurality of input data set to a predetermined length without using the margin information respectively included in the input data to be printed adjacent to each other.

Another aspect of the invention is directed to a control method for a printing apparatus that stores input data including printing information input as information to be printed on a printing medium and margin information indicating the lengths of a front margin and a back margin set in the front and the back in a printing medium feeding direction with respect to a printing region where the printing information is printed on the printing medium, the control method including: selecting a plurality of input data out of the input data; and printing, when continuously printing the selected plurality of input data on the printing medium in the order of the selection, the input data with a margin length of the input data to be printed adjacent to each other among the plurality of input data set to a predetermined length without using the margin information respectively included in the input data to be printed adjacent to each other.

According to the configuration of the aspects of the invention described above, it is possible to neglect the margin information incidental to the input data and print the input data such that the length of the margin between the input data to be printed adjacent to each other in the continuous printing is set to the predetermined length. Consequently, even when the lengths of margins incidental to the input data are different from one another, it is possible to print the input data such that the margin lengths among the input data are equal. As a result, it is possible to create an attractive print.

It is preferable that the printing apparatus according to the aspect of the invention further includes a margin setting unit configured to set a margin length between the input data to be printed adjacent to each other, and the continuous printing unit prints the plurality of input data on the basis of the margin length set by the margin setting unit.

According to the configuration described above, it is possible to meet various needs because the margin length between the input data to be printed adjacent to each other in the continuous printing can be set according to preference of a user.

It is preferable that, in the printing apparatus according to the aspect of the invention, the predetermined length is zero.

According to the configuration described above, it is possible to print the input data with the margin length between the input data to be printed adjacent to each other in the continuous printing set to zero (without a margin). Consequently, for example, when character strings are included in the input data, it is possible to print the input data without forming unnecessary spaces among the character strings. Therefore, it is possible to create a more attractive print.

Since the margin is set to zero, it is possible to suppress, when the length of a printing medium in use varies depending on contents of input data (e.g., the number of characters included in the input data), wasteful consumption of the printing medium.

It is preferable that, in the printing apparatus according to the aspect of the invention, the continuous printing unit prints, on the basis of margin information of one of the input data selected first and the input data selected last among the plurality of input data selected by the data selecting unit, a margin length of the front margin of the input data selected first and a margin length of the back margin of the input data selected last.

According to the configuration described above, it is possible to align the lengths of margins provided at the front end and the back end of a print. Therefore, it is possible to create an attractive print.

It is preferable that, in the printing apparatus according to the aspect of the invention, the continuous printing unit prints the input data without setting a margin length of the front margin of the input data selected first and a margin length of the back margin of the input data selected last among the plurality of input data selected by the data selecting unit.

According to the configuration described above, it is possible to set the lengths of margins provided at the front end and the back end of a print to zero. Consequently, it is possible to create an attractive print and suppress, when the length of a printing medium in use varies depending on contents of input data, wasteful consumption of the printing medium.

It is preferable that, in the printing apparatus according to the aspect of the invention, the data storing unit stores the input data as a file.

It is preferable that, in the printing apparatus according to the aspect of the invention, the data storing unit stores the input data already printed on the printing medium.

According to the configuration described above, an apparatus having a function of storing (saving) the input data as a file or a printing history can be provided.

Still another aspect of the invention is directed to a tape printing apparatus including the units in the printing apparatus according to the aspect of the invention. The continuous printing unit continuously prints the plurality of input data on the printing medium having a tape shape.

According to the configuration described above, the margin information incidental to the input data is neglected and the input data is printed such that the length of the margin between the input data to be printed adjacent to each other in the continuous printing is set to the predetermined length. Consequently, it is possible to provide the tape printing apparatus capable of creating an attractive label. In the configuration of the related art, it is likely that a margin between input data is longer (wider) than necessary. However, in the aspects of the invention, it is possible to prevent this problem by setting the margin length to zero and suppress a tape from being wastefully consumed.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention is explained in detail below with reference to the accompanying drawings. In this embodiment, a tape printing apparatus that creates a label by performing printing on a tape-like medium is explained as an example of a printing apparatus.

Figure 1:
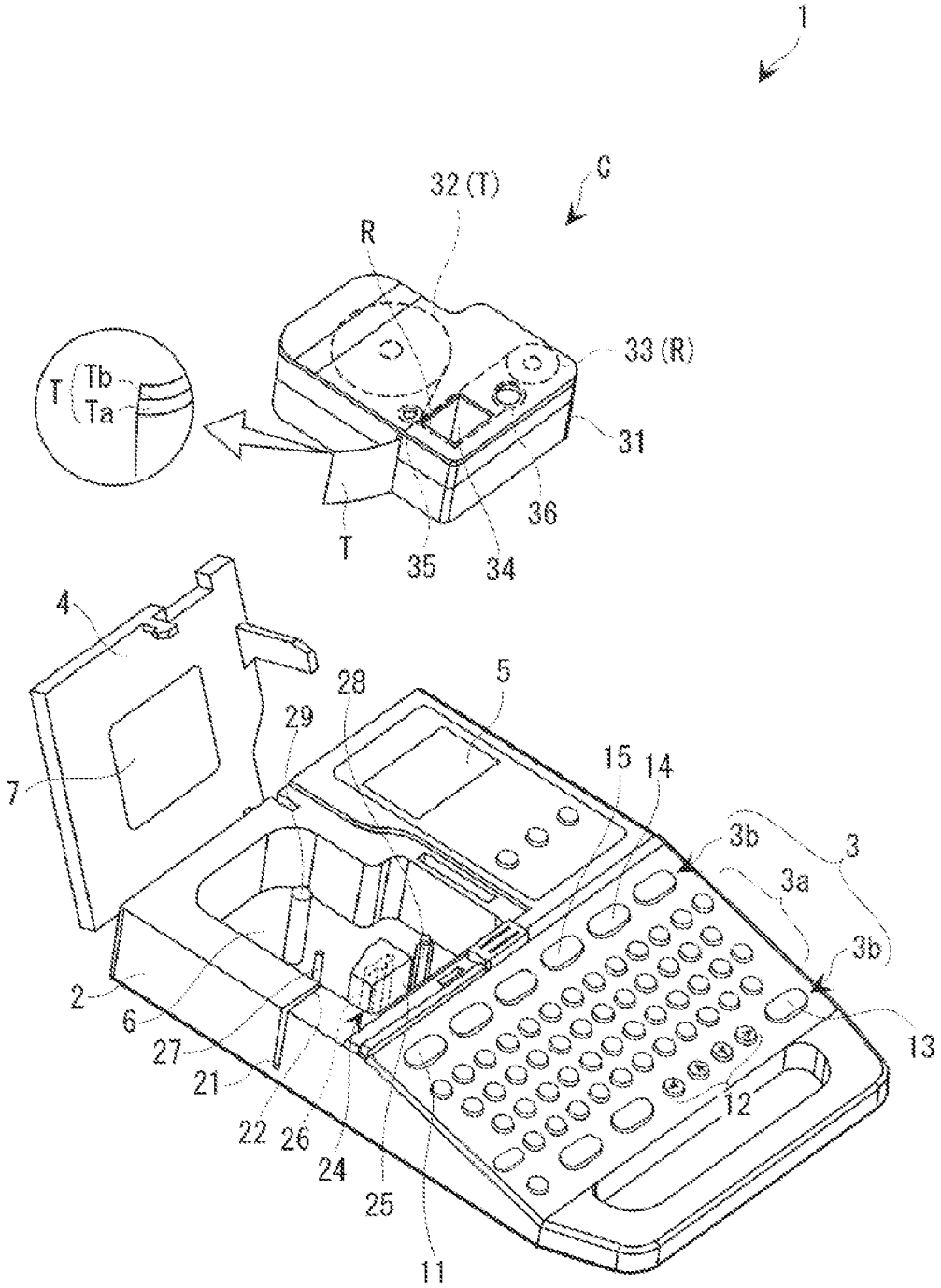
FIG. 1 is an external perspective view in an open lid state of a tape printing apparatus according to an embodiment of the invention.

FIG. 1 is an external perspective view of a state in which an opening and closing lid 4 of a tape printing apparatus 1 according to this embodiment is opened. As shown in FIG. 1, an outer shell of the tape printing apparatus 1 is formed by an apparatus case 2. A keyboard 3 including various input keys is arranged on the front upper surface of the apparatus case 2. The opening and closing lid 4 is attached to a left section of the rear upper surface of the apparatus case 2. A display screen 5 is disposed in a right section of the rear supper surface of the apparatus case 2. A cartridge mounting section 6 for mounting a tape cartridge C is formed to be recessed on the inner side of the opening and closing lid 4. The tape cartridge C is detachably mounted in the cartridge mounting section 6 in an open state of the opening and closing lid 4. An observation window 7 for visually recognizing mounting and unmounting of the tape cartridge C in a closed state of the opening and closing lid 4 is formed in the opening and closing lid 4.

On the keyboard 3, a character key group 3*a* and a function key group 3*b* for designating various operation modes and the like are arrayed. The character key group 3*a* has a full-key configuration based on the JIS array. The character key group 3*a* is the same as a character key group of a general word processor or the like in that, for example, the character key group 3*a* includes a shift key for preventing an increase in the number of keys to be operated. The function key group 3*b* includes a [print] key 11, a [cursor] key 12, a [select] key 13, a [file] key 14, and an [end] key 15.

The [print] key 11 is a key for instructing printing execution. The [cursor] key 12 is a key including up, down, left, and right keys ([↑], [↓], [←], [→]) and for performing cursor movement and scroll operation. The [select] key 13 is a key for performing selection and decision operation for a choice indicated by a cursor.

The [file] key 14 is a key for registering, as a file, input data based on information input by a user or performing, for example, plural files printing for continuously printing a registered plurality of files and creating one label besides readout, erasing, and copying of a registered file. The [file] key 14 also functions as a key for performing, for example, plural histories printing for continuously printing a stored plurality of printing histories and creating one label besides readout and erasing of data stored as a printing history (hereinafter referred to as "printing history data"). As the printing history data, the tape printing apparatus 1 automatically stores a predetermined number of (e.g., maximum five) input data in the most recent past for which printing is executed. The printing history data is different from the file. The [end] key 15 is a key for performing, when a plurality of files and a plurality of printing histories are selected and continuously printed, decision of the plurality of files and the plurality of printing histories selected by the [cursor] key 12 and the [select] key 13.

The display screen 5 is a liquid crystal display. The user uses the display screen 5 when the user checks, for example, an editing result based on input information input using the keyboard 3 and printing data generated based on the editing result.

On a left side section of the apparatus case 2, a tape discharge port 21 communicating the cartridge mounting section 6 and the outside is formed. A tape cutter 22 for cutting a fed tape T faces the tape discharge port 21. A printed tape T is fed from the tape discharge port 21 by a predetermined length. In a state in which the feeding is temporarily stopped, the printed tape T is cut by the tape cutter 22 to create a strip-like label.

Concerning cutting processing, the driving of a cutter motor 23 (see FIG. 2) can be set by setting automatic cut to "YES" or "NO" in an automatic cut setting menu or the like.

On the other hand, the cartridge mounting section 6 includes a head unit 24 in which a thermal-type printing head 26 is incorporated in a head cover 25, a platen driving shaft 27 opposed to the printing head 26, a winding driving shaft 28 for winding a below-mentioned ink ribbon R, and a positioning protrusion 29 for a below-mentioned tape reel 32. On the lower side of the cartridge mounting section 6, a tape feeding motor 30 (see FIG. 2) for rotating the platen driving shaft 27 and the winding driving shaft 28 is incorporated.

The tape cartridge C is configured by housing a tape reel 32, around which the tape T having fixed width (about 4 mm to 48 mm) is wound, in an upper center section inside a cartridge case 31 and housing a ribbon reel 33, around which the ink ribbon R is wound, in a lower right section inside the cartridge case 31. The tape T and the ink ribbon R are formed at the same width. A through-hole 34, into which the head cover 25 for covering the head unit 24 is inserted, is formed in a lower left section of the tape reel 32. Further, the head unit 24 inserted into the through-hole 34 and a platen roller 35 fit in the platen driving shaft 27 and driven to rotate are arranged to face a portion where the tape T and the ink ribbon R overlap. On the other hand, a ribbon winding reel 36 is arranged near the ribbon reel 33. The ink ribbon R fed from the ribbon reel 33 is wound by the ribbon winding reel 36 to turn around the head cover 25. That is, the ink ribbon R is wound by the ribbon winding reel 36 through a ribbon traveling path on the peripheral wall of the through-hole 34.

When the tape cartridge C is mounted in the cartridge mounting section 6, the head cover 25 is inserted into the through-hole 34, the positioning protrusion 29 is inserted into a center hole of the tape reel 32, and the winding driving shaft 28 is inserted into a center hole of the ribbon winding reel 36. The printing head 26 comes into contact with the platen roller 35 to sandwich the tape T and the ink ribbon R to enable printing. Thereafter, the user inputs a desired text (characters such as letters, numbers, signs, or simple figures) or image with the keyboard 3 while checking an editing result displayed on the display screen 5 and instructs printing by pressing the [print] key 11. Then, the tape printing apparatus 1 feeds the tape T from the tape cartridge C with the tape feeding motor 30 and selectively causes heat generating elements of the printing head 26 to generate heat to thereby perform desired printing on the tape T. A printed portion of the tape T is fed to the outside from the tape discharge port 21 as required. When the printing is completed, after feeding the tape T to a position of a tape length including a margin length, the tape feeding motor 30 stops the feeding (thereafter shifts to cutting processing).

On the other hand, the tape T is formed by a recording tape Ta, on the rear surface of which an adhesive layer is formed, and a peeling tape Tb stuck to the recording tape Ta by the adhesive layer. The tape T is wound in a roll shape with the recording tape Ta on the outside and the peeling tape Tb on the inside and housed in the cartridge case 31. As the tape T, a plurality of kinds of tapes T of different tape types (tape widths, base colors, base patterns, and materials of tapes, etc.) are prepared. The tape T (and the ink ribbon R) of one of these kinds is stored in each cartridge case 31. A plurality of holes (not shown in the figure) for specifying a type of the tape cartridge C are provided on the rear surface of the cartridge case 31. In the cartridge mounting section 6, a plurality of tape identification sensors (micro switches, etc.) 37 (see FIG. 2) for detecting the plurality of holes are provided to correspond thereto. It is possible to discriminate a tape type by detecting states of the plurality of holes with the tape identification sensors 37.

Figure 2:
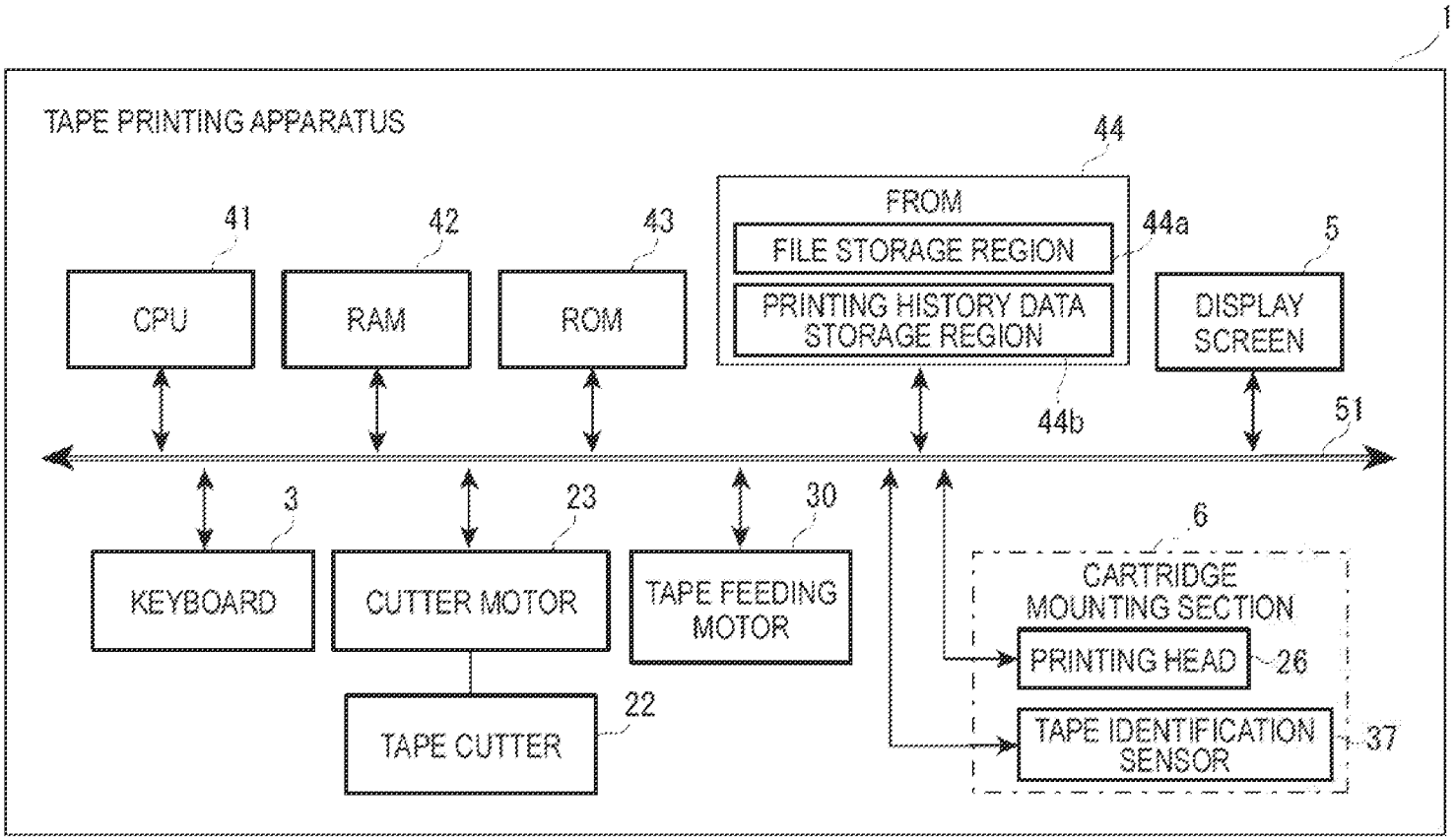
FIG. 2 is a control block diagram of the tape printing apparatus.

A control configuration of the tape printing apparatus 1 is explained with reference to control blocks shown in FIG. 2. The tape printing apparatus 1 includes a CPU (Central Processing Unit) 41, which is a central processor, a RAM (Random Access Memory) 42, a ROM (Read Only Memory) 43, a flash ROM (FROM, an input-data storing unit (a file storage region 44*a* and a printing history data storage region 44*b*)) 44, the display screen 5, the keyboard 3, the cutter motor 23, the tape cutter 22, the tape feeding motor 30, the printing head 26, and the tape identification sensors 37. The components are connected to one another via a bus 51.

The RAM 42 is used as a work area for the CPU 41 to execute various kinds of processing. The ROM 43 has stored therein a control program and various kinds of information for the CPU 41 to perform various kinds of control. As the control program, specifically, the ROM 43 has stored therein, for example, a display control program for performing display control for the display screen 5 and a plural data printing processing program for performing processing for continuously printing a plurality of files and a plurality of printing history data (plural files printing processing and plural histories printing processing) (not shown in the figure).

The flash ROM 44 includes the file storage region 44*a* and the printing history data storage region 44*b*. The file storage region 44*a* stores input data, which is input by the user, as files for the respective input data. The stored files include file numbers for specifying the files and margin information (the lengths of a front margin and a back margin set in the front and the back of a printing region of a text or the like) set by the user besides printing target information (text data, image data, etc.). Note that, since the margin information is set according to preference of the user (set according to a label to be created), margin setting is not always the same in all the files.

The printing history data storage region 44*b* stores a predetermined number of input data in the most recent past for which printing is executed. For example, the printing history data storage region 44*b* is divided into five to be capable of storing five printing history data. The printing history data are stored in first to fifth divided areas in order from the latest data, for which printing is completed, to overwrite old data stored therein (the old data stored in the first to fifth divided areas is sequentially overwritten in order from the oldest data except data having the same printing content). Note that, like the files, the input data stored as the printing history data includes history numbers for specifying the printing history data and margin information set by the user besides printing target information.

The display screen 5 functions as a display unit for displaying an editing result and a printing layout. The keyboard 3 functions as, for example, an input unit for the user to input information, an editing unit for the user to perform editing processing, and a setting unit for the user to perform various kinds of setting.

The cutter motor 23 is connected to the tape cutter 22 and functions as a cutting unit. The tape feeding motor 30 and the printing head 26 function as a printing unit for performing printing on the tape T. As explained above, the printing head 26 and the tape identification sensors 37 are provided in the cartridge mounting section 6. The tape identification sensors 37 detect a type of the tape T housed in the tape cartridge C. The CPU 41 performs, on the basis of a detection result of the tape identification sensors 37 (on the basis of a tape material, width, etc.), limitation of the number of rows and the number of characters that can be input as a text, discrimination concerning whether cutting is possible, and the like. Besides, the CPU 41 controls display processing for the display screen 5, editing processing, printing processing, and the like.

Figure 3:
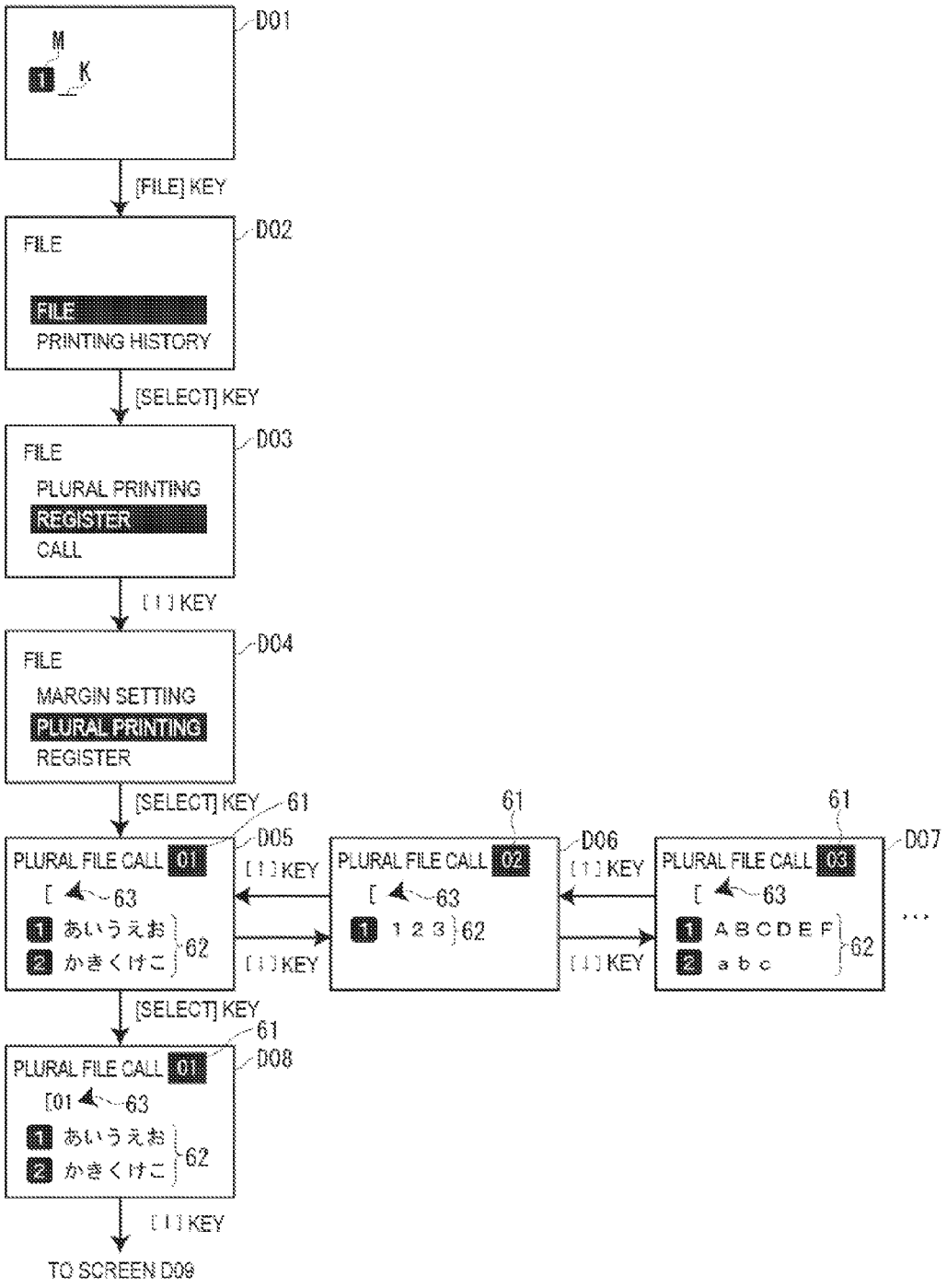
FIG. 3 is a screen transition diagram for explaining plural files printing processing.
Figure 4:
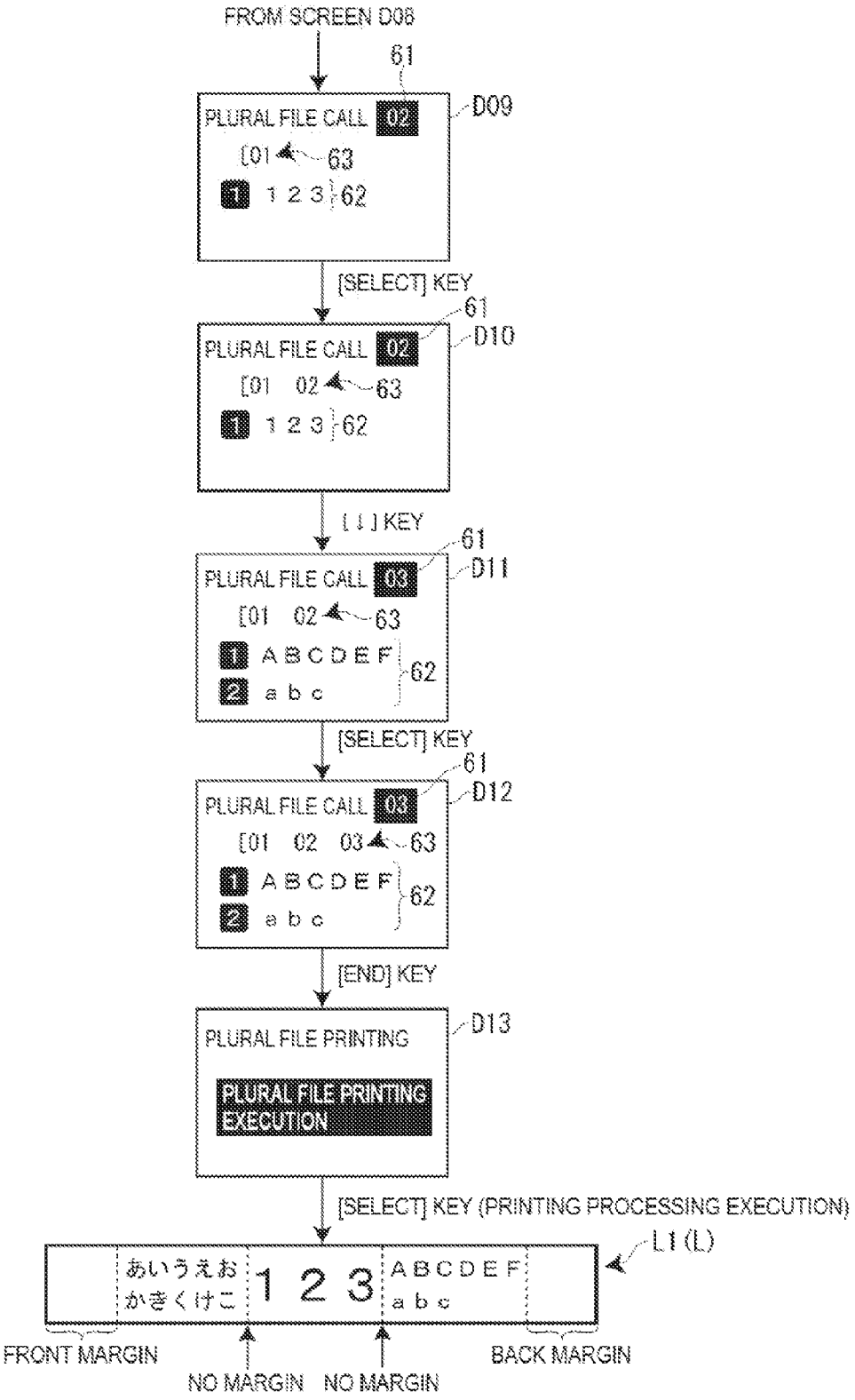
FIG. 4 is a screen transition diagram of the plural files printing processing and a diagram for explaining an example of a label to be created.

The plural files printing processing is explained with reference to FIGS. 3 and 4. FIGS. 3 and 4 are diagrams for explaining examples of a screen transition of the tape printing apparatus 1 in performing the plural files printing processing and a label L created in the plural files printing processing.

A screen denoted by a reference sign D01 (hereinafter described as "screen D") indicates an input screen for the user to input a text and the like (in FIG. 3**, an input screen in a non-input state is shown as an example). A reference sign Min the figure indicates a line head mark indicating in which row an input text is located. A reference sign K indicates a cursor indicating an input position.

When the user presses the [file] key 14 in a state in which the input screen (the screen D01) is displayed, the tape printing apparatus 1 (the CPU 41) displays a file menu screen (a screen D02) (transitions to the screen D02). On the file menu screen (the screen D02), a plurality of selection items such as a "file" and a "printing history" are displayed. The user can select any one of the items. The "file" is a selection item for performing various kinds of operation concerning files stored in the file storage region 44*a*. The "printing history" is a selection item for performing various kinds of operation concerning printing history data stored in the printing history data storage region 44*b*.

When the user selects the item "file" (presses the [select] key 13 in a state in which the "file" is reversely displayed) on the file menu screen (the screen D02), the tape printing apparatus 1 displays selection items for performing operation concerning a file. As the selection items, the tape printing apparatus 1 displays a plurality of selection items such as "plural printing", "file registration (registration)", "file call (call)", and "margin setting". The selection items can be selected by operation of the [cursor] key 12 (the [↑] key, the [↓] key, etc.) (see a screen D03 and a screen D04).

Subsequently, when the "plural printing" is selected by the user in the state of the screen D04 (the [select] key 13 is pressed in a state in which the "plural printing" is reversely displayed), the tape printing apparatus 1 displays a plural files call screen (a screen D05) for the user to select and call a desired plurality of files out of the files stored (registered) in the file storage region 44*a*.

On the plural files call screen (the screen D05), a file number (a reference number 61) and file contents (a reference number 62) of call target files are displayed. The call target files can be switched and displayed in ascending order or descending order of file numbers by the operation of the [cursor] key 12 (the [↑] key, the [↓] key, etc.)] (the screen D05 to a screen D07). The user selects a desired file while switching and displaying the files.

For example, in FIG. 3, data in which "A I U E O in hiragana characters" is entered in the first row and "KA KI KU KE KO in hiragana characters" is entered in the second row is registered as a file of a file number "01" (hereinafter described as file "01") (the screen D05). Data in which "123" is entered in the first row is registered as a file "02" (the screen D06). Data in which "ABCDEF" is entered in the first row and "abc" is entered in the second row is registered as a file "03" (the screen D07). A state in which the files are switched and displayed is shown in FIG. 3. Note that, in FIG. 3, a state in which the files "01" to "03" are switched and displayed is shown. However, this is only an example. All the registered files can be switched and displayed in ascending order or descending order.

Subsequently, when the user presses the [select] key 13 in a state in which the desired file is displayed while switching the registered files (a data selecting unit), the tape printing apparatus 1 discriminates the selected file as a printing target and displays the selected file number in a predetermined position (hereinafter referred to as "selected number display position 63"; in this embodiment, as an example, the position of the second row from the top of the screen) of the plural files call screen. For example, when the file "01" is selected as a call target first file, "01" is displayed in the selected number display position 63 (a screen D08). Similarly, when the file "02" is selected as a call target second file and the file "03" is subsequently selected as a call target third file (a screen D09 to a screen D11), the file numbers are displayed in the selected number display position 63 in the order of the selection in such a manner as "01 02 03" (a screen D12).

When the user presses the [end] key 15 on the file call screen (the screen D12), the tape printing apparatus 1 ends the file selection processing (i.e., decides the printing target plurality of files) and displays a printing check screen (a screen D13) for checking whether processing for continuously printing the selected three files in the order of the selection (plural files printing processing) is executed.

When the user presses the [select] key 13 on the printing check screen (the screen D13), the tape printing apparatus 1 actually starts the printing processing, calls the selected plurality of files (the files "01", "02", and "03") in the order of the selection, prints the files on the tape T, and creates one label L1 (L) (a continuous printing unit). In creating the label L1, the tape printing apparatus 1 prints on the basis of margin information of a file selected first (in this embodiment, margin information of the file "01"), the length of a front margin for a printing region of the file selected first and the length of a back margin for a printing region of a file selected last of the label L1 to be created (both end margins of the label L1). Note that dotted lines on the label L1 in FIG. 4 indicate margin lengths (margin regions) and are not actually printed (the same applies to the following explanation).

The tape printing apparatus 1 prints the files without providing margins among the files of the label L1 (a margin between the first file "01" and the second file "02" and a margin between the second file "02" and the third file "03"; hereinafter referred to as "intermediate margins") (prints the files without margins). That is, concerning the intermediate margins, the tape printing apparatus 1 neglects and does not use margin information stored in the files (in this embodiment, information concerning a back margin of the file "01", a front margin and a back margin of the file "02", and a front margin of the file "03") (irrespective of the margin information). After calling and printing a predetermined file (text information of the file, etc.), the tape printing apparatus 1 calls and prints the next file without providing margins (intermediate margins).

Note that the user can set the margin lengths (the lengths of both the end margins and the intermediate margins of the label L) according to "margin setting" displayed on the screen D04 shown in FIG. 3 (a margin setting unit). The margin setting is explained below with reference to FIGS. 5 and 6.

Figure 5:
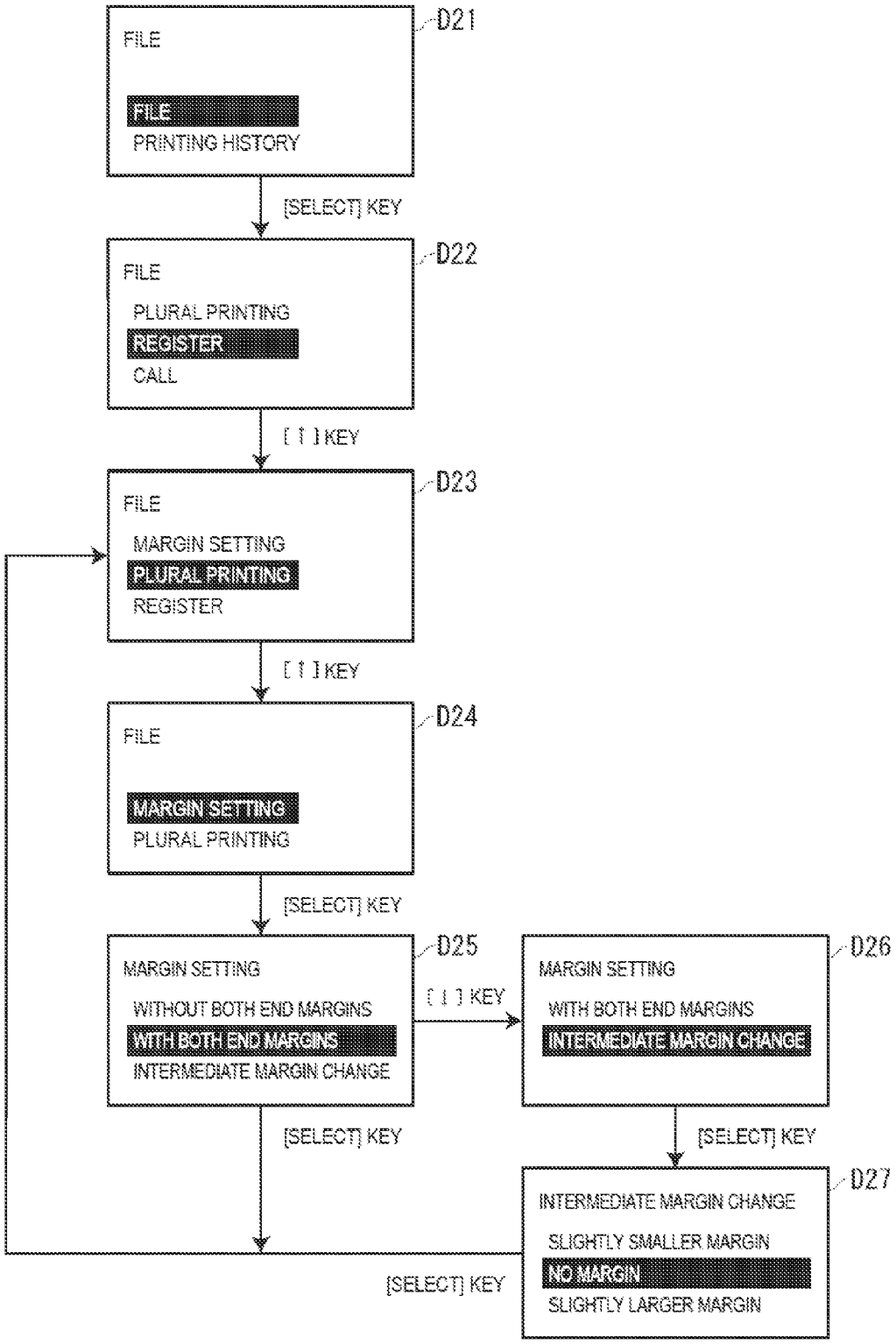
FIG. 5 is a diagram for explaining a screen transition in performing margin setting.

FIG. 5 is a diagram for explaining a screen transition of the tape printing apparatus 1 in performing the margin setting. FIGS. 6A to 6E are diagrams for explaining examples of the label L created at margin lengths set by the margin setting. As shown in FIG. 5, the "margin setting" can be set from the item "file" in the file menu screen. A screen D21 to a screen D23 shown in FIG. 5 are the same as the screen D02 to the screen D04 shown in FIG. 3. Therefore, explanation of the screen D21 to the screen D23 is omitted.

When the user operates the [cursor] key 12 (the [↑] key) in a state of the screen D23 and presses the [select] key 13 in a state in which the "margin setting" is reversely displayed (a screen D24), the tape printing apparatus 1 transitions to a margin setting screen (a screen D25). On the margin setting screen (the screen D25), the user can set each of both the end margins and the intermediate margins of the label L to be created.

As setting items of both the end margins, there are two items "without both end margins" and "with both end margins". The user selects one of the items. Note that default setting is the "with both end margins". When the user selects the "with both end margins", as explained above, the tape printing apparatus 1 sets both the end margins of the label L on the basis of the margin information of the file selected first and prints the files. When the user selects the "without both end margins", the tape printing apparatus 1 performs printing without providing both end margins of the label L to be created. That is, the tape printing apparatus 1 neglects and does not use the margin information of the file selected first (irrespective of the margin information), sets the margin lengths to 0 mm, and prints the files.

On the other hand, when the intermediate margins are set, the user selects and sets an "intermediate margin change" (a screen D26). As setting items of the "intermediate margin change", there are items "slightly smaller margin", "no margin", and "slightly larger margin". The user selects any one of the setting items (a screen D27). Note that default setting is the "no margin".

When the user selects the "no margin", as explained above, the tape printing apparatus 1 prints the files with the intermediate margins set to none (0 mm). When the user selects the "slight smaller margin", the tape printing apparatus 1 prints the files with the intermediate margins set slightly smaller (e.g., 9 mm). When the user selects the "slightly larger margin", the tape printing apparatus 1 prints the files with the intermediate margins set slightly larger (e.g., 18 mm). In both the cases, the tape printing apparatus 1 neglects and does not use the margin information of the selected files (irrespective of the margin information) and prints the files on the basis of selected lengths of the intermediate margins. Note that, after the user performs the margin setting on the screen D25 and the screen D27 (after the user presses the [select] key 13), the tape printing apparatus 1 automatically transitions to the screen on which the "plural printing" item is reversely displayed (the screen D23).

Figure 6A:
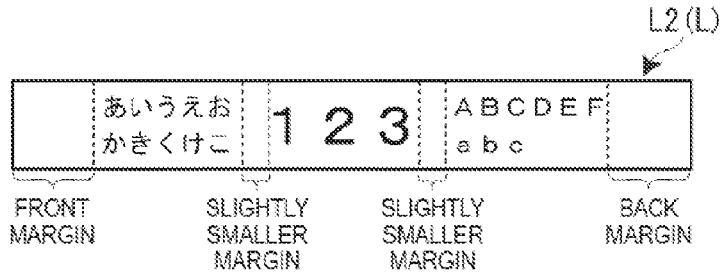
FIGS. 6A to 6E are diagrams for explaining examples of labels created at margin lengths set by the margin setting.
Figure 6B:
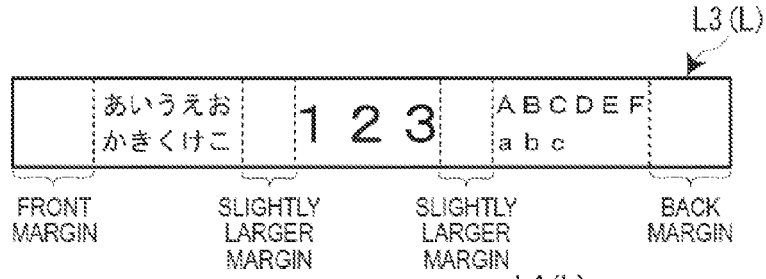

For example, when the user selects the "with both end margins" and "no (intermediate) margins" in the "margin setting" and performs printing, as the label L created by the plural files printing processing, the label L1 shown in FIG. 4 is created. That is, the label L1 with both the end margins set on the basis of the margin information of the file selected first and with the intermediate margins set to "none (0 mm)" is created. When the user selects the "with both end margins" and "slightly smaller (intermediate) margins" in the "margin setting", a label L2 shown in FIG. 6A is created. That is, the label L2 with both the end margins set on the basis of the margin information of the file selected first and with the intermediate margins set "slightly smaller (9 mm)" is created. When the user selects the "with both end margins" and "slightly larger (intermediate) margins" in the "margin setting", a label L3 shown in FIG. 6B is created. That is, the label L3 with both the end margins set on the basis of the margin information of the file selected first and with the intermediate margins set "slightly larger (18 mm)" is created.

Figure 6C:
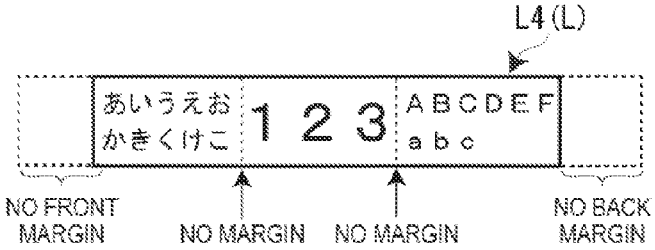
Figure 6D:
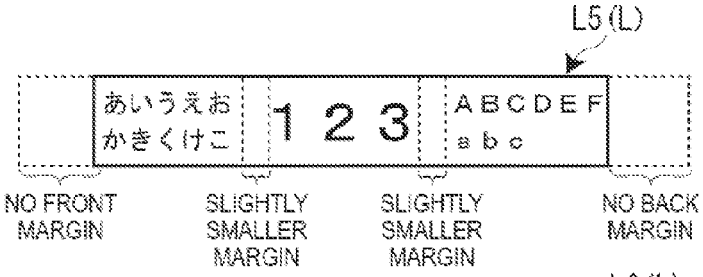
Figure 6E:
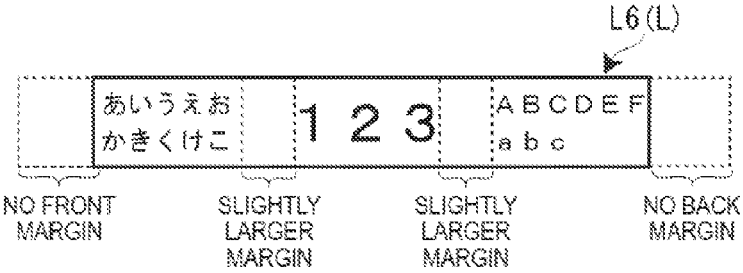

When the user selects "without both end margins" and "no (intermediate) margins" in the "margin setting", a label L4 shown in FIG. 6C is created. That is, the label L4 with both of both the end margins and the intermediate margins not provided (set to "none (0 mm)") is created. When the user selects the "without both end margins" and "slightly smaller (intermediate) margins" in the "margin setting", a label L5 shown in FIG. 6D is created. That is, the label L5 with both the end margins set to "none (0 mm)" and with the intermediate margins set "slightly smaller (9 mm)" is created. When the user selects "without both end margins" and "slightly larger (intermediate) margins" in the "margin setting", a label L6 shown in FIG. 6E is created. That is, the label L6 with both the end margins set to "none (0 mm)" and with the intermediate margins set "slightly larger (18 mm)" is created.

As explained above, according to this embodiment, it is possible to neglect and not use margin information incidental to files (input data) and print the files such that the length of a margin (an intermediate margin) between files to be printed adjacent to each other in continuous printing is a predetermined length. Consequently, even when margin information (lengths of margins) incidental to the files are different from one another, it is possible to print the files such that the margin lengths among the files are equal. As a result, it is possible to create an attractive print.

In particular, by printing the files with the margin lengths among the files set to zero (the intermediate margins set to "no margin"), for example, when texts are included in the files, it is possible to print the files without forming unnecessary spaces among the texts. Therefore, it is possible to create a more attractive print. By setting the intermediate margins to zero, it is possible to suppress wasteful consumption of the tape T compared with the tape T consumed when the intermediate margins are provided.

Note that, in this embodiment, when both the end margins of the label L are set to "with both end margins", the front margin length and the back margin length of both the end margins are set on the basis of the margin information of the file selected first. However, the setting of the both end margins is not limited to this. For example, both the end margins of the label L to be created may be set on the basis of the margin information of the file selected last. Further, it may be possible to select whether the both the end margins are set on the basis of the margin information of the file selected first or set on the basis of the margin information of the file selected last.

In this embodiment, the user presses the [end] key 15 after selecting the plurality of files (the screen D12 shown in FIG. 4) to thereby temporarily display the printing check screen (the screen D13 shown in FIG. 4). However, the printing processing is not limited to this. The user may press the [print] key 11 after selecting the plurality of files to thereby immediately start the printing processing without displaying the printing check screen (the screen D13 shown in FIG. 4).

In this embodiment, in the "intermediate margin change" of the "margin setting", when the "slightly smaller margin" is selected, the intermediate margin length is set to 9 mm and, when the "slightly larger margin" is selected, the intermediate margin length is set to 18 mm. However, this is only an example. The intermediate margin length is not limited to this. It is possible to set the intermediate margin length on the basis of specification design at the time of development, for example, set the intermediate margin length to "5 mm" when the "slightly smaller margin" is selected and set the intermediate margin length to "10 mm" when the "slightly larger margin" is selected.

In this embodiment, the three different files (the file "01", the file "02", and the file "03") are selected as the files to be selected as a printing target. However, the files to be selected are not limited to this. The files to be selected only have to be two or more. The same file may be selected a plurality of times, for example, a file to be selected first is the file "01", a file to be selected second is the file "01", and a file to be selected third is the file "02".

Figure 7:
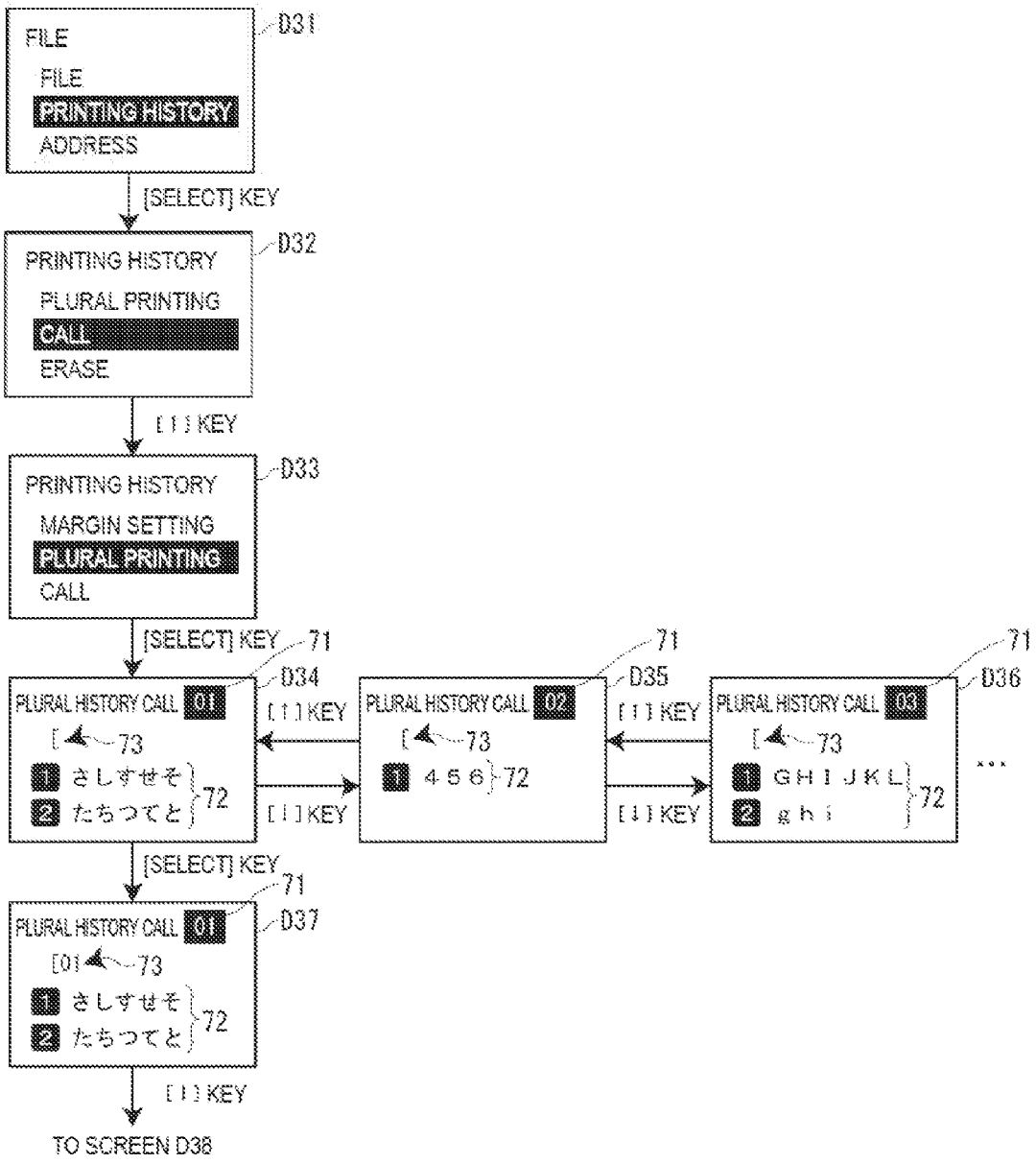
FIG. 7 is a screen transition diagram for explaining plural histories printing processing.
Figure 8:
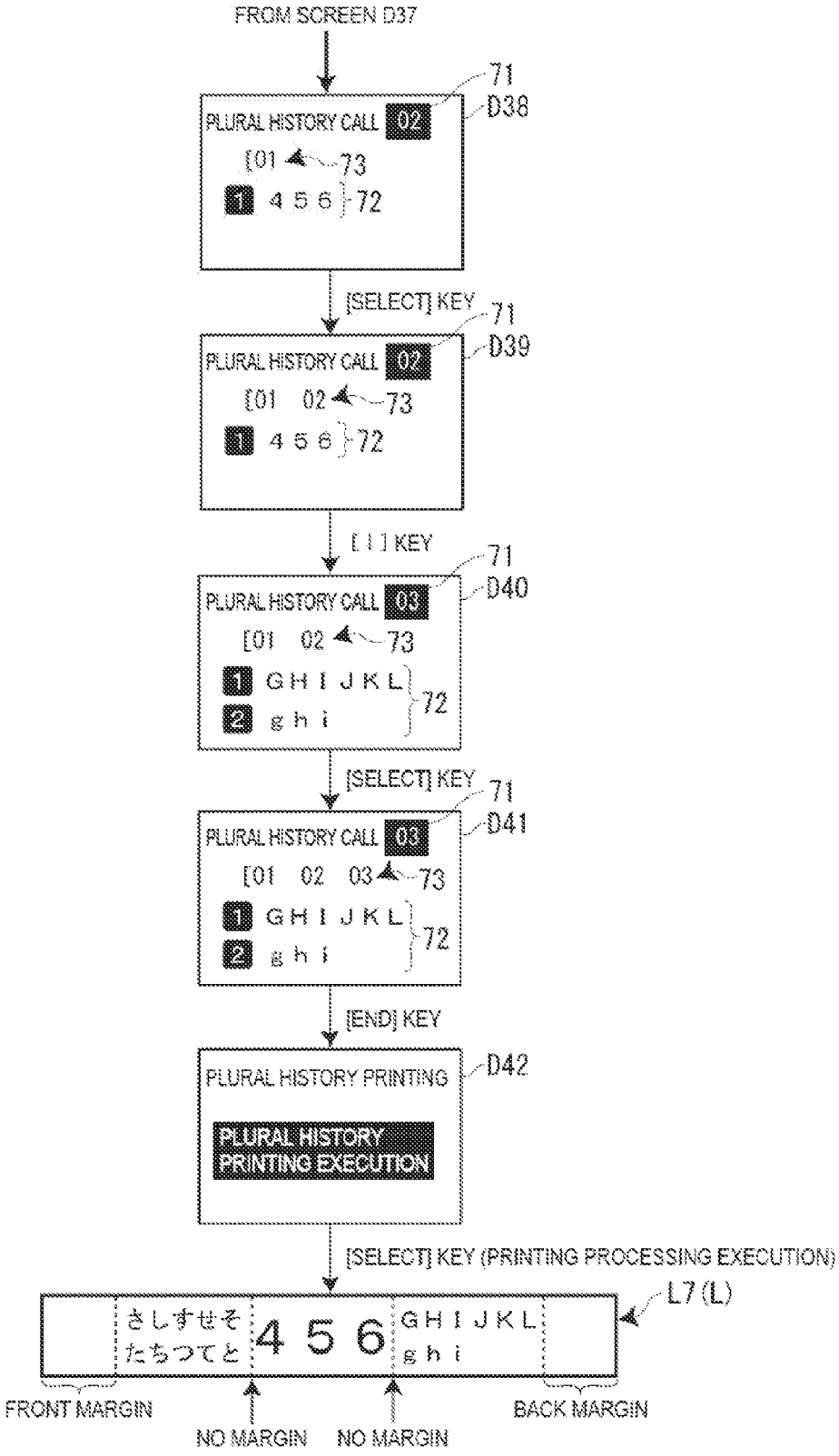
FIG. 8 is a screen transition diagram of the plural histories printing processing and a diagram for explaining an example of a label to be created.

In this embodiment, the plural files printing processing for selecting and continuously printing a plurality of files is explained. However, it is also possible to select and continuously print a plurality of printing histories instead of the files. In this case, as shown in FIGS. 7 and 8, the user selects the "printing history" from the file menu screen (a screen D31) and selects the "plural printing" in the "printing history" (a screen D32 and a screen D33). The user selects a plurality of printing history data according to a procedure same as the procedure in the case of the files explained above (a screen D34 to a screen D41; a reference number 71 indicates a printing history data number, a reference number 72 indicates content of the printing history data, and a reference number 73 indicates a display position of a history number of selected printing history data). After selecting a plurality of printing history data, the user can transition to the printing check screen by pressing the [end] key 15 (a screen D42) and continuously call the printing history data in the order of the selection and print one label L7 (L) by pressing the [select] key 13 on the printing check screen.

The invention is not limited to the thermal-type printing apparatus and can also be applied to, for example, an inkjet-type printing apparatus.

The components of the tape printing apparatus 1 explained in the embodiment can also be provided as a computer program. The computer program can also be provided while being stored in a storage medium (not shown in the figures). As the recording medium, a CD-ROM, a flash ROM, a memory card (a compact flash (registered trademark), a smart medium, a memory stick, etc.), a compact disk, a magneto-optical disk, a digital versatile disk, a flexible disk, and the like can be used.

The invention is not limited to the embodiment and can be changed as appropriate without departing from the spirit of the invention concerning the apparatus configuration of the tape printing apparatus 1, the steps of the processes, and the like.

What is claimed is:

1. A printing apparatus comprising:

a data storing unit configured to store a plurality of printing files each representing a block of text to be printed on a printing medium, each of the plurality of printing files including margin information indicating lengths of a front margin and a back margin set in a front and a back in a printing medium feeding direction with respect to a printing region where the block of text is printed on the printing medium;

a data selecting unit configured to select multiple printing files out of the plurality of printing files stored in the data storing unit; and a continuous printing unit configured to continuously print the blocks of text of the selected printing files selected by the data selecting unit on the printing medium in order of the selection, wherein the continuous printing unit prints the blocks of text of the selected printing files with a margin length of the selected printing files to be printed adjacent to each other set to a predetermined length without using the margin information respectively included in the selected printing files to be printed adjacent to each other, and wherein the predetermined length sets a front margin before a first block of text printed on the printing medium, a back margin after a last block of text printed on the printing medium, and a space length between adjacent blocks of text printed on the printing medium.

2. The printing apparatus according to claim 1, further comprising a margin setting unit configured to set a margin length between the blocks of text of the selected printing files to be printed adjacent to each other, wherein the continuous printing unit prints the blocks of text on the basis of the margin length set by the margin setting unit.

3. A tape printing apparatus comprising the units in the printing apparatus according to claim 2, wherein the continuous printing unit continuously prints the blocks of text of the selected printing files on the printing medium having a tape shape.

4. The printing apparatus according to claim 1, wherein the predetermined length is zero.

5. A tape printing apparatus comprising the units in the printing apparatus according to claim 4, wherein the continuous printing unit continuously prints the blocks of text of the selected printing files on the printing medium having a tape shape.

6. The printing apparatus according to claim 1, wherein the continuous printing unit prints, on the basis of margin information of one of the printing file selected first and the printing file selected last among the plurality of printing files selected by the data selecting unit, a margin length of the front margin of the printing file selected first and a margin length of the back margin of the printing file selected last.

7. A tape printing apparatus comprising the units in the printing apparatus according to claim 6, wherein the continuous printing unit continuously prints the blocks of text of the selected printing files on the printing medium having a tape shape.

8. The printing apparatus according to claim 1, wherein the continuous printing unit prints the blocks of text of the selected printing files without setting a margin length of the front margin of the printing file selected first and a margin length of the back margin of the printing file selected last among the plurality of printing files selected by the data selecting unit.

9. A tape printing apparatus comprising the units in the printing apparatus according to claim 8, wherein the continuous printing unit continuously prints the blocks of text of the selected printing files on the printing medium having a tape shape.

10. The printing apparatus according to claim 1, wherein the data storing unit stores each printing file of the plurality of printing files as a file.

11. A tape printing apparatus comprising the units in the printing apparatus according to claim 10, wherein the continuous printing unit continuously prints the blocks of text of the selected printing files on the printing medium having a tape shape.

12. The printing apparatus according to claim 1, wherein the data storing unit stores the plurality of printing files already printed on the printing medium.

13. A tape printing apparatus comprising the units in the printing apparatus according to claim 12, wherein the continuous printing unit continuously prints the blocks of text of the selected printing files on the printing medium having a tape shape.

14. A tape printing apparatus comprising the units in the printing apparatus according to claim 1, wherein the continuous printing unit continuously prints the blocks of text of the selected printing files on the printing medium having a tape shape.

15. A control method for a printing apparatus that stores a plurality of printing files each representing a block of text to be printed on a printing medium, each of the plurality of printing files including margin information indicating lengths of a front margin and a back margin set in a front and a back in a printing medium feeding direction with respect to a printing region where the block of text information is printed on the printing medium, the control method comprising:

selecting multiple printing files out of the plurality of printing files; and printing, when continuously printing the blocks of text of the selected printing files on the printing medium in order of selection, the blocks of text of the selected printing files with a margin length of the blocks of text to be printed adjacent to each other set to a predetermined length without using the margin information respectively included in the selected printing files to be printed adjacent to each other, wherein the predetermined length sets a front margin before a first block of text printed on the printing medium, a back margin after a last block of text printed on the printing medium, and a space length between adjacent blocks of text printed on the printing medium.

* * * * *